US006095522A

United States Patent [19]

Spell et al.

[11] Patent Number: 6,095,522

[45] Date of Patent: Aug. 1, 2000

[54] STOCK CAR RACING GAME

[76] Inventors: James A. Spell; Julise J. Spell, both of 6701 Myrtle Grove Rd., Wilmington, N.C. 28409

[21] Appl. No.: 09/238,778

[22] Filed: Jan. 27, 1999

[51] Int. Cl.[7] ..... A63F 3/00

[52] U.S. Cl. ..... 273/246

[58] Field of Search ..... 273/246, 249

[56] References Cited

U.S. PATENT DOCUMENTS

| | | | |
|---|---|---|---|
| 1,139,949 | 5/1915 | Betschart | 273/246 |
| 1,148,737 | 8/1915 | Atkins | 273/246 |
| 1,413,481 | 4/1922 | LaBorie | 273/246 |
| 3,044,779 | 7/1962 | Hvizdash | 273/246 |
| 3,231,279 | 1/1966 | Howarth et al. | 273/246 |
| 3,462,152 | 8/1969 | Royston | 273/246 |
| 3,738,659 | 6/1973 | Partridge | 273/246 |
| 3,899,177 | 8/1975 | Sells | 273/246 |
| 4,042,245 | 8/1977 | Zarour | 273/246 |
| 4,264,076 | 4/1981 | Duncan | 273/246 |
| 4,357,017 | 11/1982 | Schneider et al. | 273/246 |
| 4,624,463 | 11/1986 | Glennon | 273/246 |
| 5,048,841 | 9/1991 | Manney et al. | 273/246 |
| 5,092,605 | 3/1992 | Hoffman | 273/246 |
| 5,114,151 | 5/1992 | Bergerstock | 273/246 |
| 5,114,152 | 5/1992 | Rouse et al. | 273/246 |
| 5,139,267 | 8/1992 | Trevisan | 273/246 |
| 5,308,078 | 5/1994 | Hatter | 273/246 |
| 5,322,293 | 6/1994 | Goyette | 273/246 |
| 5,350,178 | 9/1994 | Hollar | 273/246 |
| 5,551,698 | 9/1996 | Lyon | 273/246 |
| 5,560,609 | 10/1996 | Grant | 273/246 |
| 5,749,582 | 5/1998 | Fritz et al. | 273/246 |

*Primary Examiner*—Benjamin H. Layno
*Attorney, Agent, or Firm*—Michael E. Mauney

[57] ABSTRACT

A game to simulate an automobile race. The game layout includes at least three contiguous lanes separated by parallel lines. Each lane is divided into a plurality of spaces. Each space is assigned a particular color. A player's token moves around the board a number of spaces within a lane or within a contiguous lane according to the outcome of a random number generator. A player's token may move from one lane to another only when on a particular pre-determined colored space. A player may be required to draw from a set of event cards. The event cards are designed to simulate events that occur in an actual race, such as handling problems, bad tires, the declaration of a caution during the race, or the happening of a crash during the race. Each time a player's token crosses the starting line, it is deemed to have completed a lap. The first player whose token who completes a pre-determined number of laps is declared the winner.

20 Claims, 7 Drawing Sheets

FIG. 2M
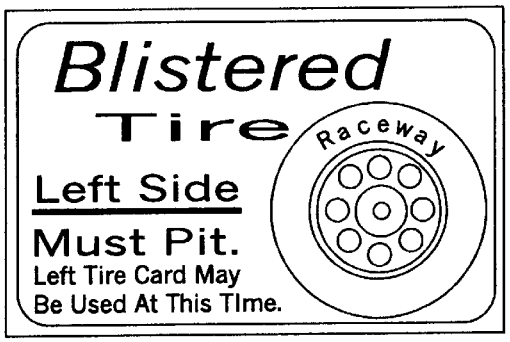
FIG. 2O
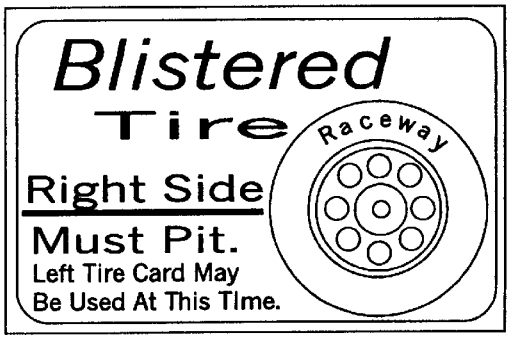
FIG. 2N
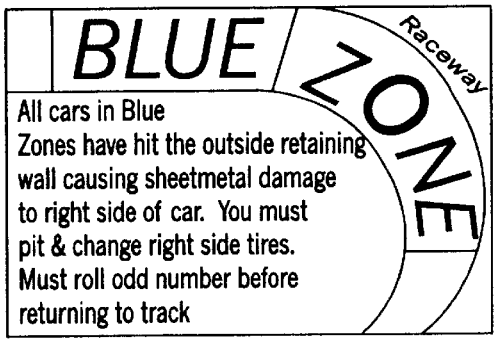
FIG. 2P
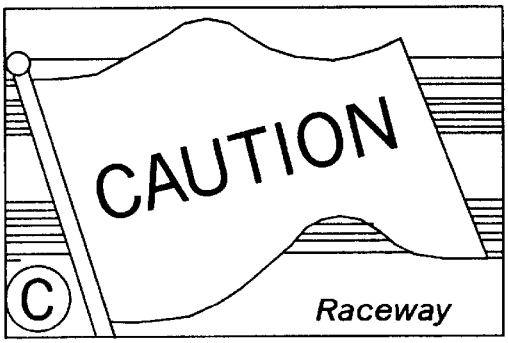
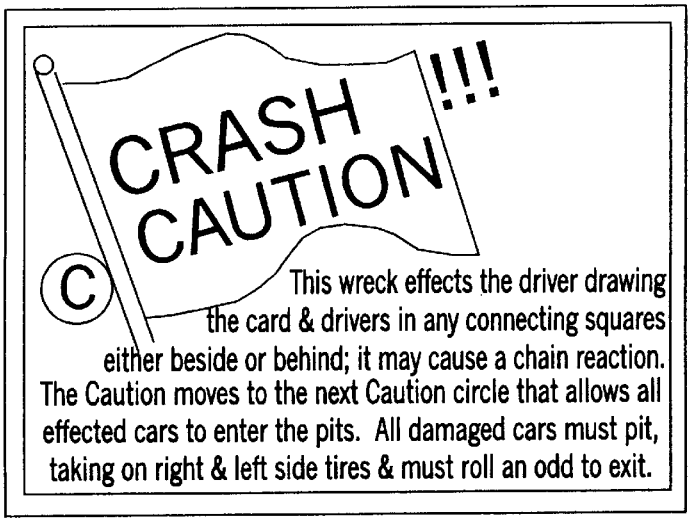
FIG. 2Q

STOCK CAR RACING GAME

BACKGROUND OF THE INVENTION

1. Field of the Invention

This invention relates to a game to simulate stock car racing. The game is designed to be employed at increasing levels of sophistication and strategy. A random number generator is used to introduce the element of chance (chance itself plays a large part in results of a stock car race). A shuffled pile of event cards also introduce an element of luck but also increase the reward to a player for strategic thinking.

2. Description of Related Art

The use of a layout displayed on a board, or displayed electronically, as a playing surface to control the play of the game is old in the art. Certainly, one of the most famous board games is "MONOPOLY"®. This game is an attempt to roughly simulate real estate development in Atlantic City. The player has a token which moves about the board based on random numbers generated by rolls of a pair of dice. The object of the game is to accumulate property and to bankrupt the other players by extracting rent from them when an opponent's token lands on property owned by the player. Another highly popular and well-known board game is "TRIVIAL PURSUIT"®. Again, a roll of the dice controls the movement of the token around the board. A player's knowledge is tested by questions based on where a player lands on the board. A player who gets to the center of the board first wins. The player who has the greatest knowledge of trivia is likely to win, but an element of chance makes this by no means certain. These games may be played electronically as well as by use of a board.

One common type of game is one that simulates a race. One effort to simulate a track competition is found in Grant U.S. Pat. No. 5,560,609. This uses an oval game board and moving player markers, and chance is introduced by the use of dice and a stack of cards. Additionally, there are board games that simulate other types of track competition, such as horse racing or Indianapolis 500 races.

However, one of the most popular types of races to simulate is the stock car racing. This has become an increasingly popular sport growing from its primarily Southeastern roots in the 1950's to be a nationwide sport widely covered even in metropolitan newspapers in the Northeast. There have been many attempts to capitalize on its widespread popularity by introducing a "stock car" board game. One example of a game simulating a Stock car race is Trevisan, U.S. Pat. No. 5,139,267. In that game, each player receives a racing card game piece and a crew chip. A dial is spun to control the play of the game. A player must answer correctly questions on cards to advance his game piece. The player whose game piece advances the quickest around the board for a predetermined number of laps is declared the winner.

Another example to simulate a stock car race on a board game is seen in Hollar, U.S. Pat. No. 5,350,178. This game uses a board piece roughly shaped like a stock car race track with a plurality of lanes. Additionally, there is a "pit row" on the board. It uses a variety of charts to determine the course and type of movement along the track based on the rolls of the dice. Dice have different colors, which indicate which chart is to be used. Rules require the players to make decisions and employ strategy similar to that that could be employed by a driver in a real stock car race. This adds to the verisimilitude of the game and makes it possible for more skillful players to more consistently win the race.

Despite all of the above efforts, none of the games have enjoyed widespread acceptance in the marketplace. It is difficult to design a game that can be enjoyed with equal appreciation by people who have little or no knowledge of racing and sophisticated racing fans. Ideally, a game should be designed to be played at different levels depending on the sophistication of the player, require a short time to learn the rules, but a lifetime to master the intricacies of the game. A game that is too easy becomes boring over time. A game whose rules are too complex and difficult to learn will be enjoyed only by the most dedicated racing fans. Therefore, it is hard to strike the appropriate balance between a game so easy that it becomes boring and a game too difficult to learn.

SUMMARY OF THE INVENTION

When played on a board, this invention employs a tri-oval shaped layout with at least three lanes delineated on the layout. Each lane is divided into separate spaces. A pair of dice are employed as a random number generator to generate numbers between 2 and 12. There is a special "pit row" lane to simulate the use of a pit in a real race to effect repairs or maintenance to a car during the course of the race. The spaces on the board have a variety of colors. The color of the space on which a player's piece lands is determinative of how the game proceeds. A player is allowed to change lanes during the course of the race. However, the player can do so only if his piece is on an appropriately colored space on the board. A player's piece landing on a denominated colored space on the board compels the player to draw an event card from a stack of cards. These cards simulate random events that can occur in the race, such as mechanical problems for the car, an accident, or even a blown engine.

The combination of the various colored spaces within the racing oval, with the random number generator pair of dice, and with the randomly shuffled cards compels a player to carefully weigh and chart his course around the oval. This requires planning and strategy.

It is an object of the current invention to require a player to plan his moves ahead in order to be able to pass slower cars. It is a further object of this invention to force a player to choose between a faster course, which may have greater risks of adverse consequences based on the draw of the event cards, versus a slower but safer route. It is a further object of this game not only to force a player to choose the most appropriate route for his tokens around the course, but also to employ his tokens to block his opponent's tokens from being able to make equally fast moves around the course. It is an object of this invention to force a player to carefully consider when and how to make pit stops in order to effect necessary repairs or maintenance to his car as the race proceeds. Finally, it is an object of this invention to employ enough chance to occasionally frustrate the most sophisticated players from always prevailing in the race. This and other objects of the invention will become clearer in the following Description of the Preferred Embodiment.

BRIEF DESCRIPTION OF THE DRAWINGS

FIGS. 2A, 2B, 2C, 2D, 2E, 2F, 2G, 2H, 2I, 2J, 2K, 2L, 2M, 2N, 2O, 2P and 2Q show the event cards used to introduce the element of chance of playing the game.

DETAILED DESCRIPTION OF THE DRAWINGS

Figure 1:
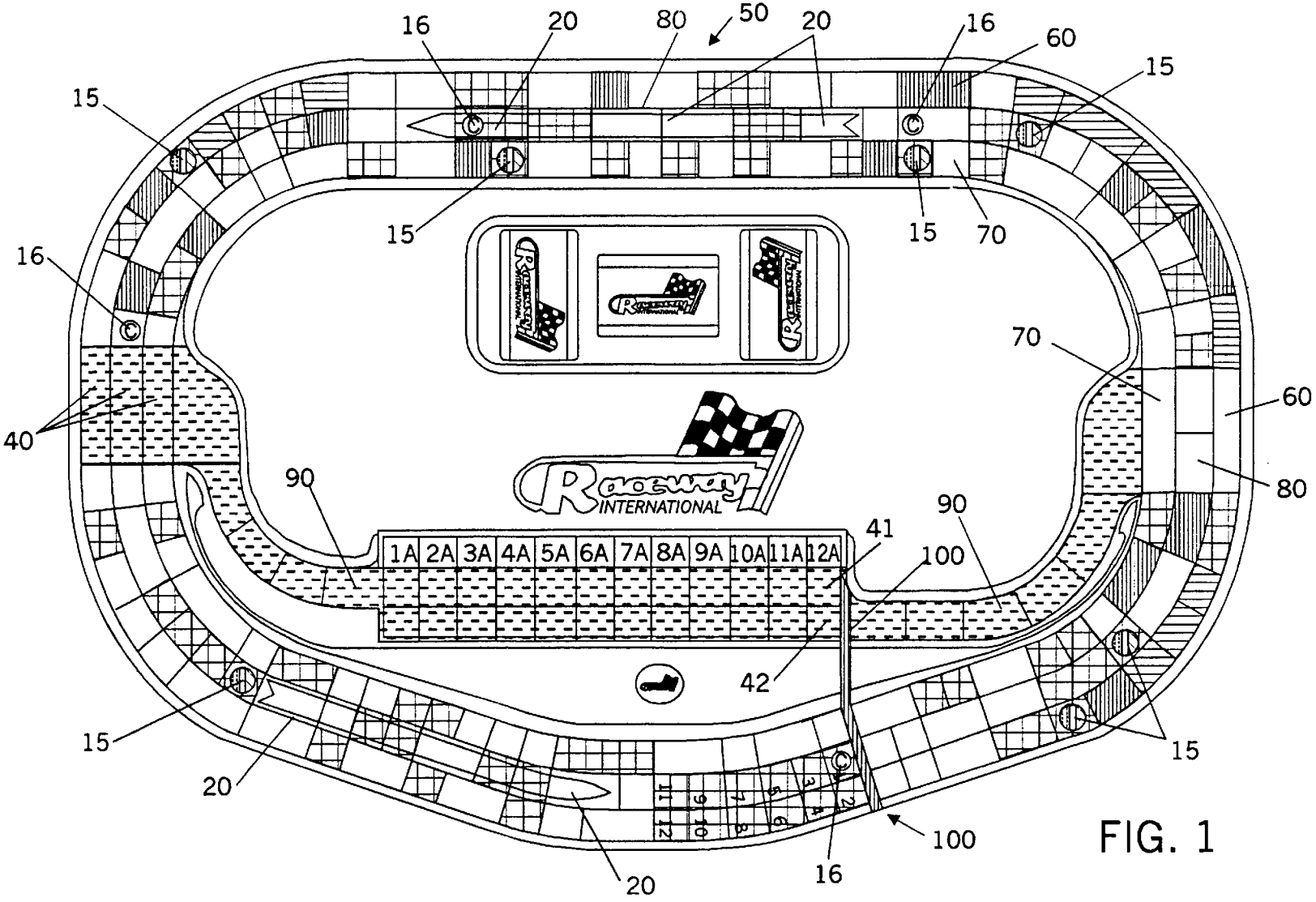
FIG. 1 is a drawing of a game layout used to play this game.

FIG. 1 is a game board used to play this game. It will be appreciated by one of skill in the art that this game may be played on a conventional printed board, but could also be played electronically on an electronically displayed board on a television screen or through such similar instrumentation. Many games are now played on a computer screen or in a dedicated video arcade game that once were exclusively played with boards, cards, or the like. Examples of these types of games are "SCRABBLE"®, TRIVIAL PURSUIT"®, and video poker machines. It is anticipated that this invention will find its most immediate application as a board game, although it is certainly adoptable to be played electronically. Here, the game board is in the general form of a stock car "tri-oval" speedway (50). Examples of these types of speedways may be seen at Daytona, Charlotte, or Talladega where major stock car races are held. A major feature of this board are lanes separated by parallel solid black lines. At least three lanes are required to play this game, although more lanes could be employed. Within the lanes individual spaces are created by lines perpendicular to the parallel lines that separate the lanes. Each space is approximately rectangular in the straightaways and rectilinear in the turns. Each player has at least one token. The game is played by advancing a player's token from one space to another contiguous space on the tri-oval speedway (50). The number of spaces a player may advance their token is based on the total count on the upturned faces of a pair of dice although, in a few circumstances, a player may choose to roll a single die. The minimum number when rolling a pair of dice is 2 and the maximum number is 12. A player would advance his token between 2 and 12 spaces for each turn unless blocked by another player's token or unless otherwise required by the rules to move a different number of spaces.

The lanes are defined by the parallel black lines, which are divided into spaces by the perpendicular black lines. FIG. 1 shows three "lanes" on the tri-oval speedway (50). The lane that is closest to the outside perimeter of the board is called the "outside lane" (60). The lane that is furtherest from the perimeter of the board is called the "inside lane" (70). Between the inside lane (70) and outside lane (60) there is a lane called the "middle lane" (80). Additionally, there is a fourth lane called the "pit lane" (90), which is located inside the other lanes. The pit lane (90) is colored gray as is shown by horizontal dashes within the lane spaces. A player enters the pit lane (90) from these 3 separate adjacent gray spaces, the pit entrance (40) located at approximately the 9 o'clock position on the tri-oval speedway (50). Within the pit lane (90), there are 12 spaces numbered 1A, 2A, 3A, 4A, 5A, 6A, 7A, 8A, 9A, 10A, 11A, and 12A. This defines the "pit area" for each player's race car token.

Each space on the tri-oval speedway (50) is defined by a particular color. Standard drafting conventions are used to demonstrate the color of the board in FIG. 1. Yellow is shown with intersecting perpendicular lines; blue is shown as parallel/horizontal lines; orange is shown as parallel/vertical lines. Within a number of the yellow spaces on the board, there is a tri-colored free turn circle (15) shown as green, violet, and white. The violet is shown by vertical dashed lines, the green by slanting parallel lines, and the no shading is shown for white. Four spaces in the center lane (80) have the letter "c" showing a caution circle (16) denoting where a caution restart occurs. Two arrows defining drafting lanes (20) are drawn in 2 portions of the center lane (80)—one drafting lane (20) appearing approximately from the 12:30 to 11:30 portion on the tri-oval speedway (50) and the other drafting lane (20) appearing from approximately the 7 o'clock to 6 o'clock position on the tri-oval speedway (50).

The inside lane (70) is divided into 56 spaces, the center lane (80) is divided into 60 spaces, and the outside lane (60) is divided into 56 spaces. Spaces colored white are neutral. All spaces with colors other than white denote some potential action, advantage, or penalty for the player landing on those spaces as determined by the rules of the game. The rules of the game will be explained later. Other numbers and letters that appear on the tri-oval speedway (50) will be explained in the description of how the rules govern play.

Figure 2A:
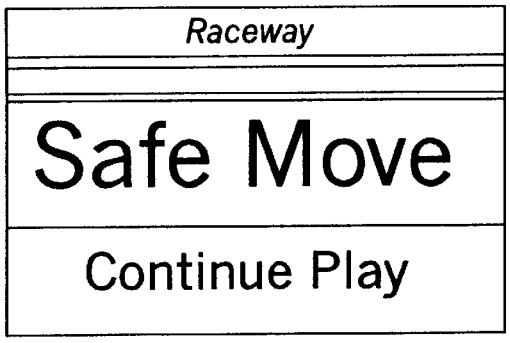

FIGS. 2A–Q illustrate event cards that are used in play of the game. There are 17 different varieties of event cards that are used. In a standard game, some of these cards are provided in multiples so that the total deck of event cards equals 34. Before starting a game, the total deck of event cards are shuffled face down and 10 event cards are removed from the event card pile and placed in a discard pile. The purpose of removing 10 event cards after shuffling the event cards face down is to create an unknown element for the players about what event cards are remaining in the event card pile that is to be used during the play of the game. The 24 event cards remaining are placed in an in-play pile and are drawn according to the rules of the game. When all 24 event cards have been drawn, they are placed in the discard pile, which should now total 34 cards. Again, these 34 cards are shuffled face down, 10 cards are removed, placed in the discard pile, with the remaining 24 cards placed in the in-play pile. This process may be repeated several times during the play of the game until the play of the game is complete. Random removal of 10 cards means that rarely, if ever, will the same 24 event cards be in play during the course of the game. A player is required to draw an event card if his token comes to a stop on any of the orange spaces shown on the tri-oval speedway (50). The tri-color circles (15) on the board entitle one to receive a free turn if one's token lands in this space. The rules of the game allow one to utilize that free turn at the time one lands on a tri-color circle (15) or to save this free turn to be used later in the game if necessary. Knowing when and how to use free turns is an important part of the strategy of the game.

During the course of the play of the game, a player is required to enter the pit lane (90) to replace his left side tires, to replace his right side tires, and to gas up. This is will be explained in more detail in the portion of the application dealing with the play of the game. To denote pit requirements and to help the players keep track of these requirements, cards are distributed at the beginning of the game to each player so that the player will know when he has met his pitting requirements. These cards are a left side tire card, a right side tire card, and a gas card (not illustrated). These cards themselves do not play any function in the play of the game, but are simply ways to help the player keep up with the pit requirements of the game. Likewise, free turn cards (not illustrated) are given to a player who lands on a free turn space and who desires to save that free turn until a later point in the game. Any convenient way of helping a player keep track of his pit stop requirements and free turns would work as well. Thus, a player could use a counter, a note pad to record these requirements, or the like. Unlike the deck of event cards, which come into play during the course of the game, the left side tire cards, right side tire cards, gas cards, and free turn cards do not require any action of the player, but simply are used as convenient reminders to a player during the game.

FIGS. 2A–2Q illustrate all varieties of event cards. A player landing on an orange space must draw an event card.

Figure 2D:
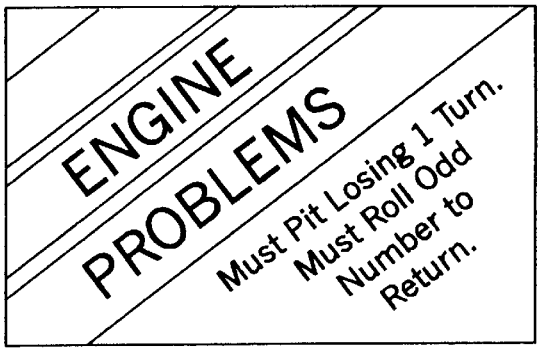
Figure 2B:
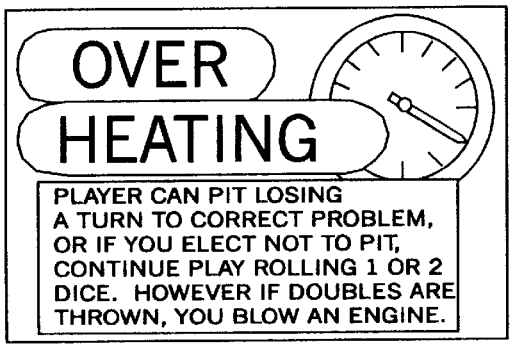
Figure 2E:
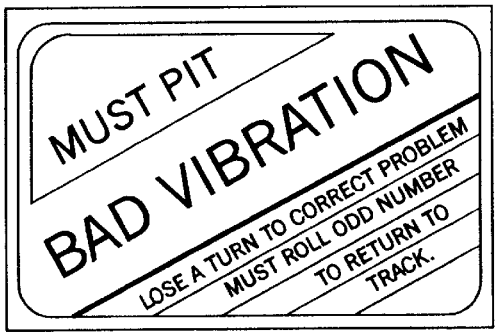
Figure 2C:
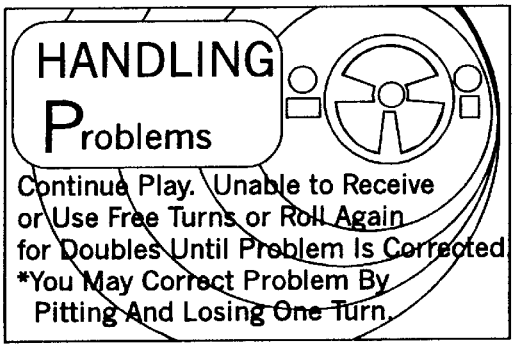
Figure 2F:
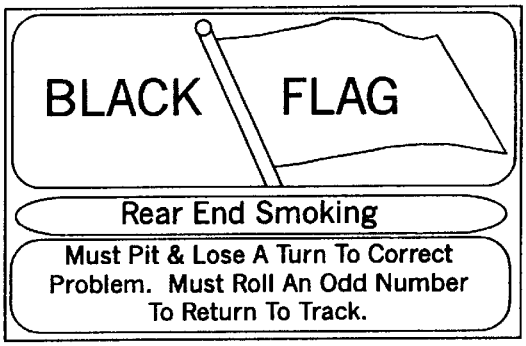
Figure 2G:
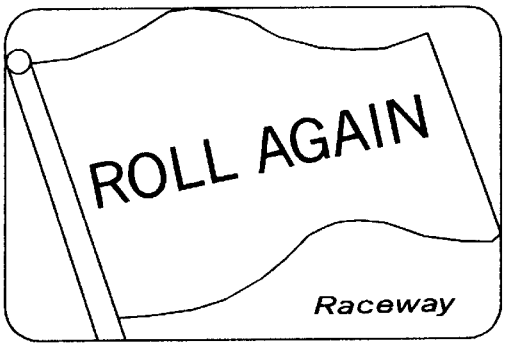
Figure 2J:
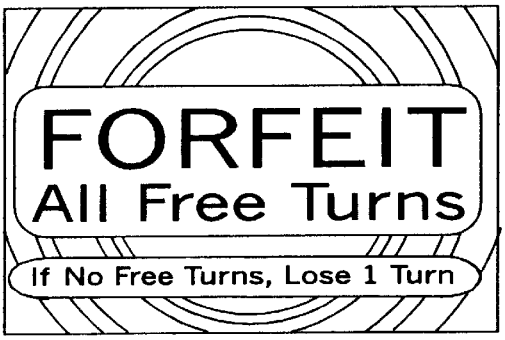
Figure 2H:
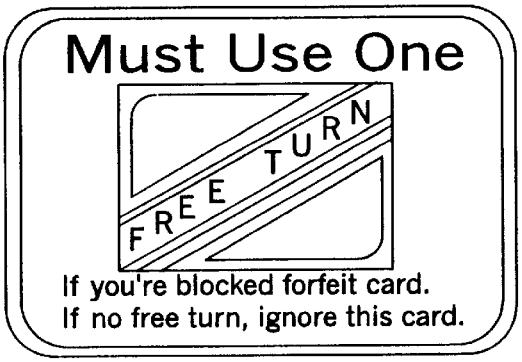
Figure 2K:
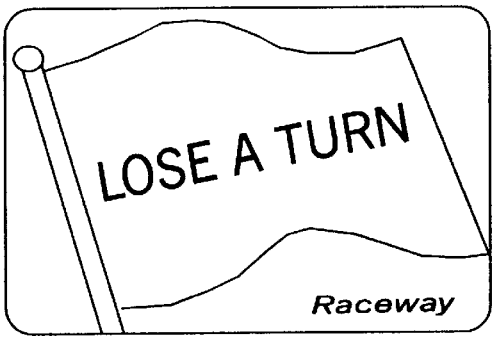
Figure 2I:
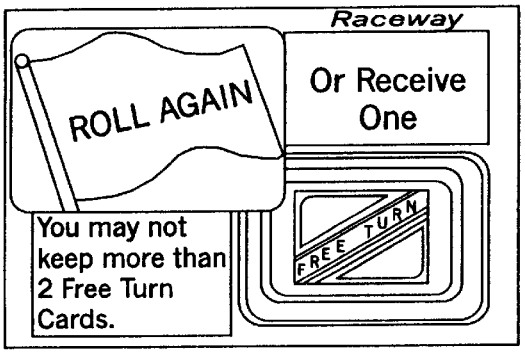
Figure 2L:
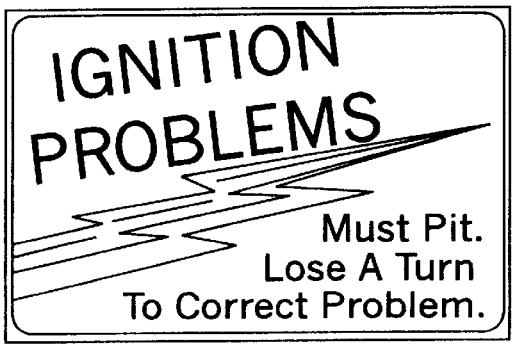

FIG. 2A shows the safe move card. This is a neutral card and does not affect play. There are 6 safe move cards. FIG. 2B illustrates the overheating card. This requires a player to pit to correct the problem. The player may elect to continue to play, but with penalties as shown on the card in FIG. 2B. FIG. 2C illustrates the handling problem card. You may correct this by pitting or continue to play, but with penalties as shown on the card in FIG. 2C. FIG. 2D illustrates the engine problem card. A player must pit, lose one turn, and must roll an odd number to be able to exit from the pit. FIG. 2E illustrates the bad vibration card. One must pit, must lose a turn to correct the problem, and one must roll an odd number to exit the pit. FIG. 2F illustrates the black flag card. This means that one's vehicle has a smoking rear end. The player must pit, lose a turn to correct the problem, and roll an odd number to return to the track. FIG. 2G illustrates a roll again card. This means a player is entitled to roll again and advance their token the number of spaces provided in the rules by the result of the re-roll of the dice. There are 3 roll again cards. FIG. 2H shows a must use a free turn. The requirements for using a must use a free turn card (2H) are shown on the card. There are 2 of these cards. FIG. 2I shows a roll again or receive a free turn card. This card entitles the player to choose between rolling again hence, advancing one's token, or to receive a free turn card (not shown) to be saved to be used under other circumstances. There are 2 of these cards. FIG. 2J shows a forfeit all free turns card. This requires a player to forfeit all accumulated free turn cards. If a player does not have any free turn cards, then one must forfeit a turn. There are 3 of these cards. FIG. 2K is a lose a turn card. This means a player who draws this card must lose his next turn. There are 3 lose a turn cards. FIG. 2L is the ignition problem card. The player must enter his pit area and must lose a turn to correct the problem. FIG. 2M is the blistered tire, left side card. The player must pit. If the player has a left side tire card (not shown), it may also be discarded at the same time, losing only 1 turn. FIG. 2N is the blue zone card. This is the only event card in the game which affects not the player drawing the card, but only other players whose token is in a blue space on the tri-oval speedway (50). Here, if another player's token is in a blue-colored space on the tri-oval speedway (50), they are deemed to have hit the outside retaining wall. Each player whose token is in a blue space must then enter their pit area to correct the damage and to change the right side tires. A right side tire card (not shown) may be discarded at the same time, losing only 1 turn. These players are required to roll an odd number before returning to the track. FIG. 2O illustrates the blistered tire, right side card. One must pit to correct this problem. One may discard the right tire card at the same time, losing only 1 turn. FIG. 2P is a caution card. There are 5 caution cards in the deck. FIG. 2Q is the crash caution card. There is only one crash caution card in the deck. Use of the caution card (2P) and the crash caution card (2Q) will be explained later.

Basic Game Equipment

The game can be played by up to 12 participants. If 6 or less people are playing the game, then each player may use more than one token hence "race" more than one car. In order to play the game, certain equipment will ordinarily be furnished. First, is the raceway game board described in FIG. 1. Second, are the event cards described in FIGS. 2A–Q. The rules require each player to change their right and left tires during the game. Hence, each player will be furnished with a left and right tire card (not shown). Rules also require a player to make a pit stop to get gas. This requirement is denoted by the gas card furnished to each player (not shown). There are 12 tokens (not shown) that move around the board that denote race cars. The game will ordinarily be furnished with at least one pair of dice (not shown), although as many as 12 separate pairs of dice could be employed in the event there were 12 players. Additionally, there is a starting line and pit area recorder (not shown) to keep up with the starting order and with who is assigned to what pit area. There is a scoring tray with magnetic lap markers to keep up with the number of laps completed so each player will know what lap he is on (not shown). Additionally, there are a number of free turn cards, which will be used by the players to keep up with who has accumulated free turns by landing on the tri-color free turn space (15) on the board or by drawing the free turn event card shown in FIG. 2I. It will be appreciated by one of skill in the art that there are alternate ways of keeping up with starting order, laps completed, pit stops and the like. The above described items are simply a convenient way of keeping a record of certain rule requirements. These particular items are not themselves a necessity for play of this game. Once the game is set up, the game is played as is described in the following paragraphs.

Basic Rules

The race runs in a counter-clockwise rotation beginning at the start/finish line (100) located at approximately the five-thirty position on the tri-oval race track (50) as shown in FIG. 1. Each player advances his token on the board the number of spaces corresponding to the total on the dice determined by the roll of the dice. A player may not move diagonally or in reverse on the board. He may move forward. He may move to either side if he is in a yellow passing space. The yellow spaces on the board denote where a player may move his token laterally, hence, are like passing lanes. One may never move into a space occupied by another player's token. One may not move over a space occupied by another player's token. One must move around another player's token if the rules permit. Otherwise, one must stop one's forward progress and wait until the other player's token is out of the way before proceeding. If a player's token is resting on a yellow passing space on the board, when it is his turn to move, he may move laterally on the board to an adjacent space unless that space is occupied by another player's token. If a player rolls doubles, that is, if the up number on each die is the same, then the player may advance his token that number of positions and has the option to roll again, but is not required to roll again, before the turn to roll passes to the next player. However, a player rolling doubles three consecutive times is deemed to have destroyed his engine and is disqualified from further play.

Starting Play

Each player must choose a token representing a car and choose a pair of dice. Each player will roll the dice. The player with the highest total will be given the space numbered 1 at the start/finish line (100) on the tri-oval speedway (50). This same player will be assigned space #1A in the pit area. In the event two players roll the same number, they will continue to roll their dice until one player successfully rolls a higher number, who will then be given the lower pit and starting place. The starting order of play determined will ordinarily be recorded. Each player will be assigned a starting space number 1 to 12 at the start/finish line (100) on the tri-oval speedway (50). Each player will have the corresponding space on pit road (90) respectively numbered 1A to 12A. This will be important in the event of the necessity of "restarting" the race in the event of a caution, which will be described later. Once every player has rolled and a starting order has been determined, starting spaces and pit spaces have been assigned, each player is given a left side tire card, a right side tire card, and a gas card, which denotes the requirements of the game that they pit to change tires and to gas up at least once during the course of the race. The players then begin to play by rolling their dice and moving their tokens around the board. As play proceeds, they must pass other tokens on the board, use the drafting lanes (20), enter the pit area, and deal with cautions. These situations are described as follows.

Using Passing Spaces

Figure 3A:
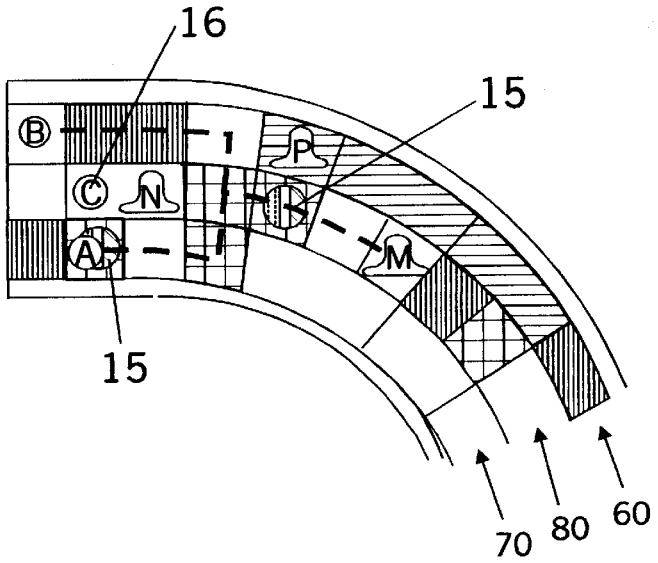
FIGS. 3A and 3B demonstrate use of the passing spaces.

A simple example of a passing situation is shown in FIG. 3A. FIG. 3A shows a portion of the turn leading into the back straightaway of the tri-oval speedway (50). Illustrated in this portion of the tri-oval speedway (50) is a free turn circle (15) and a caution circle (C) (16). To illustrate passing, token (M) is starting on a white neutral space in the middle lane (80). Four spaces ahead of token (M), token (N) is blocking the forward progress of token (M). However, immediately behind token (N) is a yellow passing space. Thus, if the player using token (M) rolls a 6, he may advance token (M) 3 spaces to the yellow passing space. The rules require token (M) to continue to move by utilizing the passing space. Because he is in the middle lane (80), he may either pass by moving to the outside lane (60) or may pass by moving to the inside lane (70), advancing to positions A or B as is shown in the illustration. This simple passing situation nevertheless illustrates some of the strategy and subtlety of playing the game. The player using token (M) has a choice to pass by the inside lane (70) or the outside lane (60). If he chooses the outside lane (60), his token advances further around the board and is positioned immediately before an orange space on the board. Therefore, if someone is coming behind him in the outside lane, they will be forced to stop on the orange space since they cannot utilize a yellow space to change lanes. This requires that individual to draw from the event cards. Here, suppose the player using token (P) is leading the race and was a full lap ahead of the player using token (M) before the player using token (M) moved his token. By choosing to pass in the outside lane (60), token (M) will now be in position B blocking token (P). Perhaps more importantly, when the player using token (P) takes his turn, he will stop on the orange space immediately behind position B. The player using token (P) will then be required to draw cards from the event card pile (2A–2Q). Should he draw a caution card (2P) or a crash caution card (2Q), it will be an enormous advantage to the player using token (M), whose token will eventually be lined up only a few spaces behind the token of player (P), in effect, allowing player using token (M) to advance his token almost a full lap. This situation is explained in more detail in the portion of this application that describes the use of the caution event card (2P) and the crash caution event card (2Q). On the other hand, if player (M) has no particular interest in forcing the player using token (P) to draw from the event card pile (2A–2Q), he could choose to pass on the inside lane (70). His token would then stop at position A in the space containing the free turn circle (15). This would allow the player using token (M) to receive a free turn. Hence, the decision about whether to pass on the inside lane (70) or the outside lane (60) is highly dependent on the progress of the game and the immediate goals of the player using token (M).

Figure 3B:
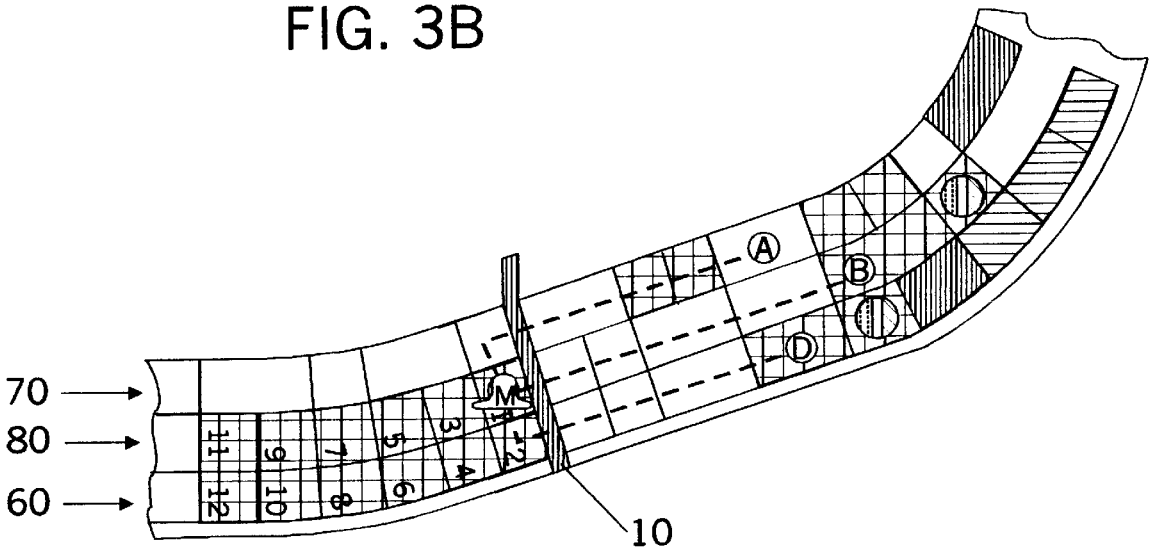

FIG. 3B shows an example from the front straightaway of a player's options in the event that he is resting on a yellow space at the time it is his turn to move. In this illustration, token (M) is in the middle lane (80) and resting on a yellow space. The player using token (M) rolls a 5. There is no token in front of this player. Therefore, he may proceed directly forward 5 spaces to position B or he may move laterally to the inside lane (70) and proceed forward to position A. Finally, he may move laterally to the outside lane (60) and proceed forward to the position D. As in FIG. 3A, the choice a player makes will depend on a number of factors. These would include where the other players tokens are on the board and the possibility of one of these tokens blocking the forward progress of the instant player's token. Additionally, he must consider where his token is relative to the other players' tokens in the overall position of the game—that is, is he close to leading, is he far behind, and so on. The subtleties of this part of the strategy of the game can only be learned over time with experience and by the player using judgement. A player must choose when and how he changes lanes carefully. First, any lateral move means the player's token is not advancing around the board as quickly as possible. However, a player must utilize strategic thinking to avoid being blocked by a token in front of him, to land on free turn spaces if possible, to appropriately block a following player's token, and so on.

Although the middle lane (80) has more spaces hence, is "longer" than either the outside lane (60) or inside lane (70), it does provide an advantage in that if one is in a yellow space, hence, passing lane, in the middle lane (80) one may move laterally to the outside lane (60) or to the inside lane (70). This is in contrast to the inside lane (70) where one may only move laterally to the middle lane (80). Likewise, in the outside lane (60) one may only move laterally to the middle lane (80). Thus, if one is traveling in the shorter inside lane (70) or outside lanes (60), one is more likely to be blocked by an opponent's token or tokens, because the options provided by the passing lane are more restricted in these lanes than is the case in the middle lane (80).

Drafting

In regular stock car racing, one car may "draft" another car. This means that the following car positions itself so close to the lead car that wind resistance is reduced hence, making the following car use less energy to travel at the same rate of speed as the lead car. This procedure is simulated by the drafting lane (20) shown in FIGS. 1, 4A and 4B. In FIG. 1 the tri-oval speedway (50) has two drafting lanes (20) on the board. The first is on the back straightaway and the second is coming out of the fourth turn heading toward the finish line. They are indicated by the arrows that are drawn on the tri-oval speedway (50) in the middle lane (80). Both drafting lanes are in the middle lane (80). How they work is illustrated in FIGS. 4A and 4B.

Figure 4A:
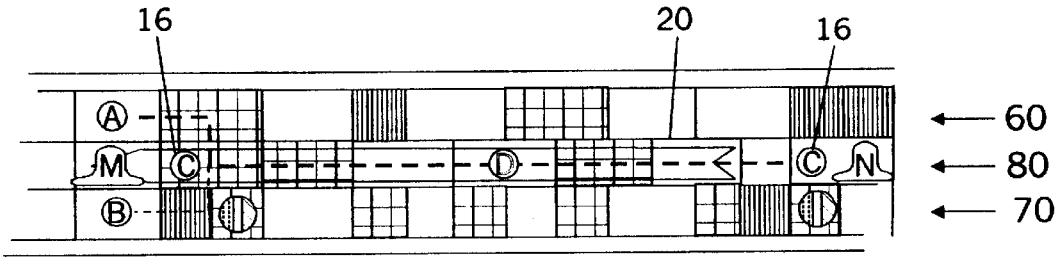
FIGS. 4A and 4B demonstrate use of the drafting lanes.

In the first example in FIG. 4A (taken from the back straightaway on the tri-oval speedway (50)), a player using token (M) is located in the space at the apex of the arrow indicating the drafting lane (20) in the middle lane (80). A player using token (N) is located 8 spaces behind token (M) also in the middle lane (80). For drafting to occur, a token must be located somewhere within the drafting lane (20). In this case, token (M) qualifies. The player using token (N) is not required to be within the drafting lane (20) at the start of his roll of the dice. In FIG. 4A, the player using token (N) rolls a 4. He advances his token 2 spaces to the space with beginning of the drafting lane (20). However, because token (N) is in a drafting lane, it may immediately advance all the way up to the space immediately behind token (M) without counting anymore for his roll. In effect, the player using token (N) got to skip 5 spaces. The player using token (N) is now in the space immediately behind token (M) which is a yellow passing lane, thus the player using token (N) may move to the inside lane (70) or the outside lane (60) arriving at the spaces labeled with A or B on FIG. 4A. Without the benefit of the drafting lane, the player using token (N) would have to stop in the space labeled D in FIG. 4A. Thus, the drafting lane (20) enables the player using token (N) to advance his token substantially further because of the drafting lane (20), thus, simulating some of the effects of drafting in an actual race.

Figure 4B:
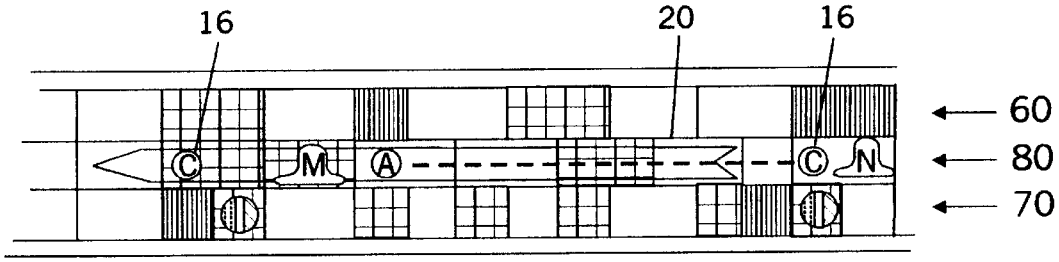

However, in some circumstances, a drafting lane is not helpful, as is shown in FIG. 4B. Again, consider the player using token (N). Only now token (M) is located 6 spaces in front of token (N), rather than 8 spaces in front of token (N) and there is no yellow space immediately behind token (M). Now suppose the player using token (N) rolls a 12. This player advances his token (N) two spaces to the first part of the drafting lane leaving him 10 spaces yet to move on his roll of 12. He immediately advances 3 more spaces to position A in FIG. 4B without counting off of his roll, leaving 10 spaces yet to move. However, because token (N) is not in a yellow space, the token (N) cannot pass token (M). Token (M) blocks his forward progress and the player using token (N) is required to forfeit the remaining part of his move. Here, the effect of the drafting lane was to require the player using token (N) to forfeit 10 spaces, rather than 7 spaces, as would have been the case had there been no drafting lane. But with or without the drafting lane, the player using token (N) would have still been in position A blocked behind token (M). The drafting lane would have only been of benefit to the player using token (N) had he rolled something less than 5. For example, had the player using token (N) rolled a 2 on his pair of dice, he would still have advanced to position A, 5 spaces in front of him because of the benefit of the passing lane. But ultimately token (N) would be blocked by token (M).

Pit Stops and the Use of Pit Road

In FIG. 1 the pit entrance (40) is located between the third and fourth turns of the track at the approximate 9 o'clock position on the tri-oval speedway (50). One may enter the pit lane (90) from any lane on the tri-oval speedway (50). For example, if one is in the outside lane (60) and one wishes to enter the pit lane (90), one may cross laterally to enter pit lane (90). You may not otherwise use the pit entrance (40) to move laterally. Once one has started to move laterally on the pit entrance (40), one is then required to enter pit lane (90) and to exit properly from the pits, as will be explained later. Within pit lane (90) there are 12 numbered stalls, which are assigned at the time the starting order is assigned. Thus, the player who is assigned starting place #1 on the tri-oval speedway (50) has pit stall #1A, the player who has starting place #2 is assigned pit stall #2A, and so forth. The entering and exiting area of pit lane (90) is a single lane. Within pit lane (90) in the stall areas there are 2 lanes. One is the entrance road (41) and one is the exit road (42). One enters a pit stall number 1A to 12A only from the entrance road (41) and one exits the pit lane (90) only on the exit road (42). One may be blocked on both the entrance road (41) and exit roads (42) by other players' tokens. The numbered pit stalls count as a space. To enter a pit stall one must advance to that space. If one rolls a higher number than is required to advance to the space, the remaining part of the number is forfeited. Once one is in a pit stall, when one's turn comes next, one may then gas, take on left or right side tires, or do repairs required by an event card, but forfeiting the roll of the dice for that turn. No more than one pair of tires can be taken for each turn. Hence, once one is in one's pit stall, you must forfeit a turn to take on left side tires, forfeit another turn to take on right side tires, and forfeit another turn to take on gas. When and how to exit the pit is an important judgement. It is important not to be lapped while one is in the pit. If a player makes a mistake and enters the pit when a player is not required to, he still must proceed to his pit stall and lose a turn before he can exit. As one exits the pit, one crosses the start/finish line (100). This is viewed as scoring another lap. Once a player is beyond the start/finish line, even if still on pit road (90), he may use free turn cards to move around the track faster. Free turn card may not be used on pit road (90) before one's token has crossed the start/finish line (100). This simulates a race where the drivers who are leaving pit road and begin to accelerate back to regular track speed.

Various event cards (2A–2Q) require that one enter pit road (90) to effect repairs. Also, one is required by the rules of the game to enter pit road, to replace one's left side tire cards, one's right side tire cards, and to take on gas during the course of the race. One may replace tires at any point during the race. However, in order to simulate an automobile race, one is ordinarily required to pit to take on gas somewhere during the middle part of the race. For example, if the race is 12 laps, one is required to stop for gas during the fourth, fifth, sixth, and seventh laps. If a player does not pit, that is passes the pit entrance (40) when required to stop by either one of the event cards (2A–2Q) or because of requirements to take on gas, the player can continue to move his token around the track, but the lap recorded will not count in his total. He will then enter the pit road (90) the next time he approaches the pit entrance (40), but having "wasted" a lap.

Caution and Crash Caution Event Cards

Figure 5A:
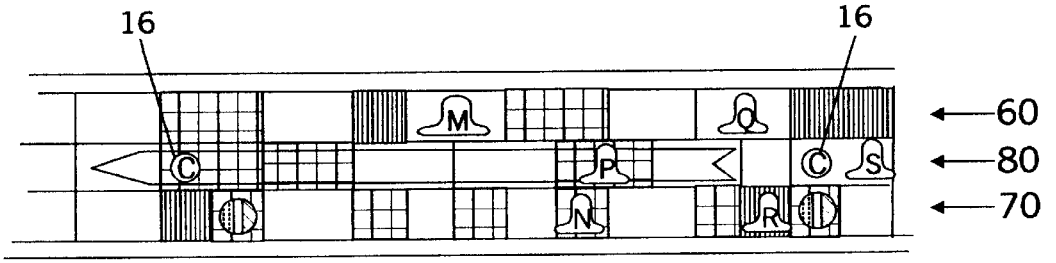
FIGS. 5A, 5B, 5C, 5D, and 5E demonstrate how the caution event cards work.
Figure 5B:
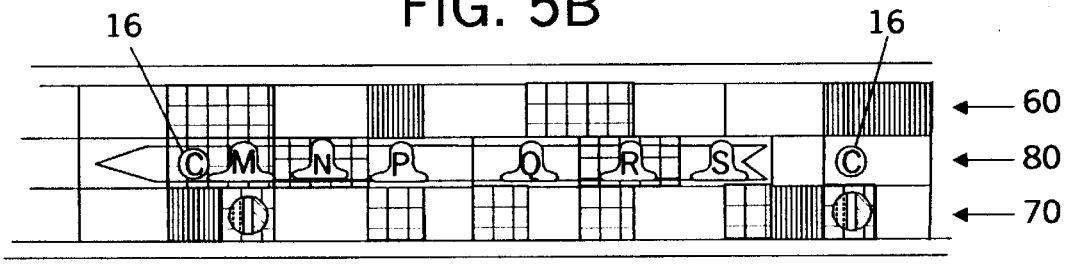

The caution card (2P) and crash caution event card (2Q) are perhaps the most advanced part of the game. For beginning players or young children, these event cards may be omitted from the event card pile to simplify play of the game. However, once the player is familiar with the overall play of the game, the use of these cards adds interest and strategic thinking to the play of the game. When a caution card (2P) is drawn, the leader of the race must be determined. This is the person who has accumulated the most laps and is furtherest along the track toward the start/finish line at the time of the drawing caution card (2P). The token of the leading player moves to the next caution circle (16), with the letter "C" therein. All tokens in the same lap will be lined up single file behind the leader in the same lane where the caution circle (16) appears. They will be lined up in the order in which they were running on that lap, not according to their position in the race. The leader restarts the race. The restart sequence for cars behind the leader will be in the order of the starting line up order. This means the next token to move may not be the token immediately behind the leader in the caution line up. FIGS. 5A and 5B illustrate the procedure in the event of the drawing of a caution card (2P). Six players are spaced on a portion of the back straightaway. The leader is the player using token (M); second place is the player using token (N), the third place player is using token (P) and so on to the sixth place player using token (S). Here, token (M) who is the leader advances to the caution circle (16) as shown in FIG. 5B. Immediately behind token (M) is token (N), followed by tokens (P), (Q), (R), and (S). Please note that token (N) is placed behind token (M) because the player using token (N) is closest to the player using token (M) in his "on track" position on that lap. The player using token (N) may actually be one or 2 laps behind the player using token (M) in the overall race results. Once the caution card (2P) is drawn, then the leader of the race always restarts the race. In this case, it would be the player using token (M). If the player using token (M) had been in the third position in the starting order, then the next player whose turn comes will be the player who is in fourth position in the starting order.

Figure 5C:
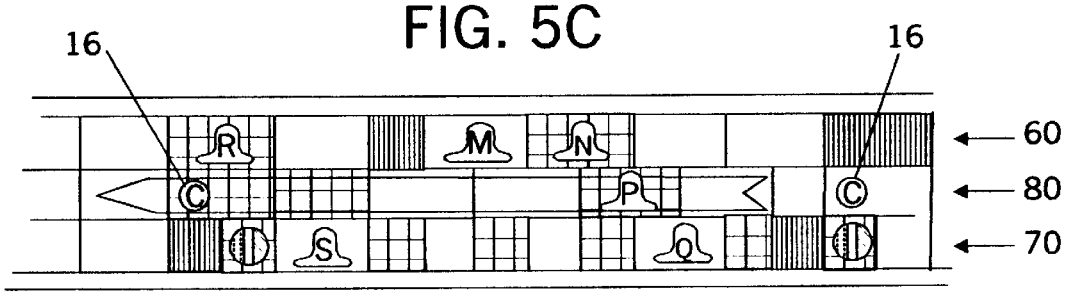
Figure 5D:
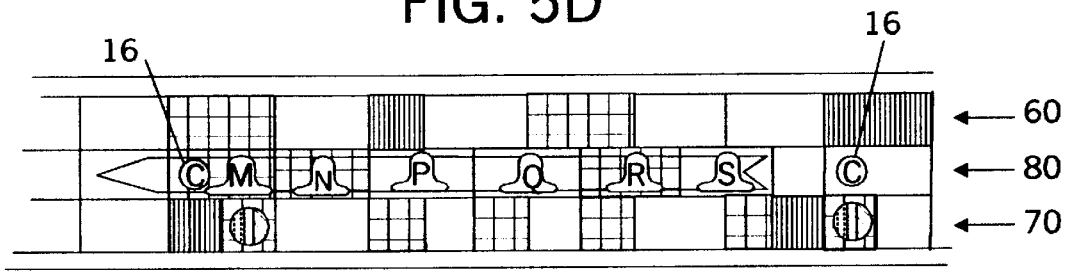

This could be any of the remaining players. Even though the player using token (N) may be immediately behind token (M), that player may not be the next to play unless he immediately follows behind the player using token (M) on the starting order card. Now consider the position in FIG. 5C. Again, the player using token (M) is the leader of the race. Players using token (R) and (S) are about to be lapped by the player using token (M). A caution card (2P) is drawn. The player using token (M) advances his token to the caution circle (16) as shown in FIG. 5D. The player using token (N) who is next "on track" position, even though he may be 1 or 2 laps down, is placed immediately behind token (M), followed respectively by token (P) and (Q) as shown in FIG. 5D. Token (R) and (S), who are about to be lapped, are placed at the end with token (R) being ahead of token (S) because the player using token (R) was somewhat further ahead in the "on track" position in FIG. 5C. The draw of the caution card (2P) here was an immediate advantage to the players using token (R) and (S), who in effect advanced all the way around the track, crossing the start/finish line (100), recording a new lap, and then lining up behind token (M), respectively only 4 and 5 spaces behind as shown in FIG. 5D, rather than almost the entire 50+ spaces that they would have otherwise been behind. When players line up for a restart in a caution, the orange spaces that require a player to draw an event card, the drafting lanes, and the free turn spaces (15) are disregarded for this occasion only. Once every player has moved, then the use of the orange spaces, the drafting lanes (20), and the free turn spaces (15) is resumed. These spaces are viewed as a neutral white space only during the restart. If a caution is declared and players tokens cross the pit road entrance (40), they have the option of going to their pit stall rather than lining up immediately behind the leader in the caution restart area. A player who has entered the pit road when a caution is declared must move immediately to his pit stall. Any player who is required to move pass the pit road entrance (40) as part of the caution has the option of entering pit road (90) and going to his assigned pit stall. If a player is in his pit stall when a caution is drawn, he may exit the pit road and fall in behind the field only if he has lost a turn in his pit stall to take on tires, gas, repairs, or the like.

It is important to note that, if players were in adjacent spaces so that no one player may be deemed ahead of the other, the player on the inside lane (70) is deemed ahead of players in the middle lane (80) and outside lane (60), and the player in the middle lane (80) is deemed ahead of the player in the outside lane (60). Also, it is important to note that only during a restart a player may change lanes even though he is not starting on a yellow space.

Figure 5E:
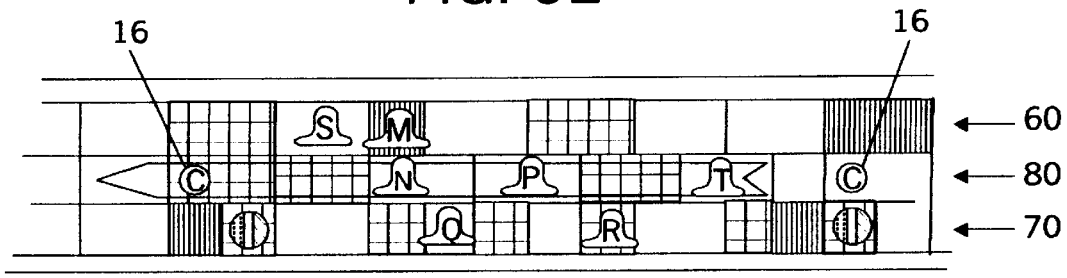

There is one crash caution card FIG. 2Q in the deck. This card effects not only the driver drawing the card, but also all drivers in any connecting squares either beside, behind, or diagonal. This event card simulates a chain reaction, multiple car crash, which sometimes happens in stock car racing. As with a regular caution card (2P), the leader advances to a caution circle (16). However, when a crash caution card (2Q) is drawn, the leader is always advanced far enough around the track to a caution circle (16) ahead of pit road (90) so that all damaged cars may immediately enter the pit road (90) at the pit entrance (40). This could mean moving the leader past one or more caution circles (16). All damaged cars, which include the driver of the car drawing the crash caution card (2Q), as well as any drivers in affected squares, must enter the pit. Once inside the pit, they must change left and right side tires and must roll an odd number to return to the track. FIG. 5E demonstrates the use of a crash caution event card (2Q). In FIG. 5E there are 7 different tokens visible in this portion of the back straightaway of the tri-oval speedway (50). Here, the player using token (M) has landed on a orange space requiring him to draw an event card. For purposes of FIG. 5E, it is assumed that the player using token (M) draws the crash caution event card (2Q). When a crash caution event card (2Q) is drawn, it simulates a chain reaction crash. It is assumed that any tokens that are beside or in immediately adjacent spaces to token (M) are involved in the crash. It is also assumed that any tokens that are immediately beside or behind any tokens immediately beside or behind the token of the player drawing the crash caution card are also affected by the crash. For a token not to be affected, it must be separated by a space from any space occupied by a token affected by the crash caution card (2Q) or it must be ahead of the token of the player who drew the crash caution card. Here, token (S) is ahead of token (M), hence, would not be affected. Token (N) is immediately beside token (M), hence, would be involved in the chain reaction crash. Token (Q) is in a space immediately beside the space occupied by token (N), hence, would also be affected in the chain reaction crash. Token (P) is immediately behind the space occupied by token (N), hence, would also be affected. Token (R) would be affected because the space occupied by token (R) is diagonally adjacent to the space occupied by token (P). The player using token (T) would not be affected because the space occupied by token (T) is not in a space connected to any of the spaces occupied by tokens that are involved in the crash caution. As illustrated in FIG. 5E, the crash caution event card (2Q) was drawn in a space on the back straightaway. The leader must pass the pit road entrance (40) and advance to the caution circle (16) at the start/finish line (100). This allows all cars involved in the crash caution to enter the pit and to begin to effect the necessary repairs. Here, that would be tokens M, N, P, Q, and R. If the leader of the race is required to enter the pit area to make repairs, the race will restart behind the leading token that is not required to pit.

Determining a Winner

The first player whose token completes the required number of laps is considered the winner. The player who finishes second is the player who has the next highest number of laps and whose token is closest to the start/finish line at the time the winner's token crosses the start/finish line. If one wishes to play a quick game, only a few laps will be required to complete the race. That could effect strategy during the course of the race. Typically, a race will be ten laps. When one player's token has crossed the start/finish line so that it is now in the last lap of the race, then this lap is called the "white flag" lap. This lap is called the "white flag" lap because in races when the leader of a race crosses the start/finish lap with only one more lap to go, a white flag is waved to all other cars in the race. Oftentimes, this will affect the strategy of the car that is leading the race as well as cars that are close to the lead. A permitted variation in the rules as described in the preferred embodiment, is that on the "white flag" lap drawing of the event cards (2A–2Q) may be suspended, the use of free turn cards may be suspended, and the like. This simulates the typical change in strategy of a real race in the "white flag" lap.

It will be appreciated by one of skill in the art that many variations are possible in the above described rules and equipment without departing from the basic spirit of this invention. For example, one could design the game layout in a shape or form other than a tri-oval speedway. For example, a road racing course could easily be simulated by simply changing the configuration of the game layout from a tri-oval speedway to a road racing type layout. The basic principles of the lane of passing, pitting, and utilizing the caution and event cards strategically to win the race would be the same regardless of the precise shape of the board. Likewise, lanes could be added, more event cards could be added to the pile, or event cards could be deleted form the pile. For example, it is expected for novice game players or for children it might be appropriate to delete the crash caution card or the caution cards or some of the other cards that result in more complicated play and more complicated strategy. Nothing in the foregoing description of the preferred embodiment is intended in any way to limit the scope of the invention, which is defined solely by the claims which follow.

What is claimed is:

1. A game to simulate an automobile race comprising:

(a) at least two playing tokens simulating at least two automobiles participating in a race whereby a player of said game uses at least one of said tokens;

(b) a game playing layout to simulate an automobile race track having at least three contiguous lanes, each of said lanes divided into a plurality of distinct spaces where said token moves around said game playing layout in said lanes;

(c) a random numbered generator which is used to generate a number to determine a number of spaces in said contiguous lanes said token may advance for a turn;

(d) a plurality of randomly ordered event cards, a first side of said event cards containing instructions regarding play of said game with a portion said event cards stacked so that said first side of said event cards containing instructions are face down whereby a player of a game does not know the content of instructions on said event card until one of said event cards is drawn during play of the game;

(e) for said plurality of distinct spaces, at least one of said distinct spaces specially marked so that when one of said playing tokens stops on said specially marked distinct space a player is required to draw one of said event cards from said portion of randomly ordered event cards stacked face down, said plurality of distinct spaces including at least one of said distinct spaces marked with a caution circle;

(f) said plurality of event cards to include at least one caution event card, said caution event card containing instruction for declaring order of play to simulate a caution during a race whereby said caution event card requires the token of leading player to move to next distinct space marked with a caution circle and said remaining tokens to be placed in a predetermined order at predetermined distinct spaces on said board thereby resulting in said tokens advancing around said lanes to said predetermined distinct spaces without using said random number generator;

(g) means for ordering progress of said tokens around said lanes whereby strategy, skill, and luck play a part in how far said token advances so that one of said token to first complete a predetermined number of laps around any of said lanes determines a winner of said simulated automobile race.

2. A game to simulate an automobile race of claim 1 wherein said game playing layout has a fourth lane connected to at least one of said contiguous lanes whereby a token may enter said fourth lane to simulate an automobile entering a pit lane during a race.

3. A game to simulate an automobile race of claim 2 wherein a portion of one of said contiguous lanes is marked for a first predetermined number of distinct spaces and said means for ordering includes drafting means for ordering to allow a player's token to advance more spaces than allocated by said random number generator when said token lands in first predetermined number of distinct spaces.

4. A game to stimulate an automobile race of claim 3 wherein there is at least one color assigned each of said plurality of distinct spaces.

5. A game to simulate an automobile race of claim 4 wherein said means for ordering includes a pitting means for ordering whereby a token must enter said fourth lane at least once during the course of the play of a simulated automobile race whereby changing tires and taking on gas is simulated.

6. A game to simulate an automobile race of claim 5 wherein said means for ordering includes a passing means for ordering whereby said token of player may move laterally in one of said distinct spaces to adjacent distinct space.

7. A game to simulate an automobile race of claim 6 wherein said plurality of randomly marked event cards includes at least one crash caution event card in said plurality of event cards whereby said crash caution event card requires an action to be performed by at least one token affecting progress of said token around said contiguous lanes to simulate the effects of a multi-car crash occurring during the course of an automobile race.

8. A game to simulate an automobile race comprising:

(a) at least two playing tokens simulating at least two automobiles participating in a race whereby a player of said game uses at least one of said tokens;

(b) a game playing layout to simulate an automobile racetrack having at least three contiguous lanes, each of said lanes divided into a plurality of distinct spaces where said token moves around said game playing layout in said lanes;

(c) a random number generator which is used to generate a number to determine a number of spaces in said contiguous lanes said token may advance for a turn;

(d) means for ordering progress of said tokens around said lanes whereby strategy, skill, and luck play a part in how far said token advances so that one of said token to first complete a predetermined number of laps around any of said lanes determines a winner of said simulated automobile race;

(e) at least one drafting lane comprising a predetermined number of adjacent spaces along a portion of one of said continuous lanes, said adjacent spaces marked with an indicia extending length of said adjacent spaces defining said drafting lane means for ordering including means for allowing a first player's token which moves to the beginning of a drafting lane, according to said random number generator, to advance all the way up the drafting lane to a space immediately behind another player's token only if another player's token is located on a space in a drafting lane ahead of first player's token, wherein the first player's token advances more spaces than allocated by said random number generator.

9. A game to simulate an automobile race of claim 8 further comprising a plurality of randomly ordered event cards, a first side of said event cards containing instructions regarding play of said game with a portion of said event cards stacked so that said first side of said event cards containing instructions are face down whereby a player of a game does not know the content of instructions on said event card until one of said event cards is drawn during play of game and for said plurality of distinct spaces at least one of said distinct spaces specially marked so that when one said playing token stops on such specially marked distinct space a player is required to draw one of said event cards from said portion of randomly ordered event cards stacked face down.

10. A game to simulate an automobile race of claim 9 wherein said plurality of event cards to include at least one caution event card and said plurality of distinct spaces including at least one distinct space marked with a caution circle, said caution event card containing instruction for declaring order of play to simulate a caution during a race whereby said caution card requires token of leading player to move to next distinct space marked with a caution circle and said remaining tokens to be placed in a predetermined order at predetermined distinct spaces on said board thereby resulting in said tokens advancing around said lanes to said predetermined distinct spaces without using said random number generator.

11. A game to simulate an automobile race of claim 10 wherein said game playing layout has a fourth lane connected to at least one of said contiguous lanes whereby a token may center said fourth lane to simulate an automobile entering a pit lane during a race.

12. A game to simulate an automobile race of claim 11 wherein there is at least one color assigned to each of said plurality of distinct spaces.

13. A game to simulate an automobile race of claim 12 wherein said means for ordering includes a pitting means for ordering whereby a token must enter said fourth lane at least once during the course of a play of a simulated automobile race whereby changing tires and taking on gas is simulated.

14. A game to simulate an automobile race of claim 13 wherein said means for ordering includes a passing means for ordering whereby token of said player may move laterally in one of said distinct spaces to an adjacent distinct.

15. A game to simulate an automobile race of claim 14 wherein said plurality of randomly marked event cards includes at least one crash caution event card in said plurality of event cards whereby said crash caution event card requires an action to be performed by at least one token affecting progress of said token around said contiguous lanes to simulate the effects of a multi-card crash occurring during the course of an automobile race.

16. A method of playing a game simulating an automobile race comprising:

(a) providing, at least two playing tokens simulating at least two automobiles participating in a race whereby a user of said method of playing a game uses at least one of said tokens;

(b) providing a visual depiction of a game playing layout to simulate an automobile track having at least three contiguous lanes, each of said lanes divided into a plurality of distinct spaces;

(c) providing a random number generator to generate a number to determine a number of distinct spaces in said contiguous lanes said token may advance for a turn;

(d) providing a plurality of randomly ordered event cards, first side of said event cards containing instructions regarding play of said game with a portion of said event cards stacked so that said first side of said event cards containing instructions are face down whereby a player of a game does not know the content of instructions on said event card until one of said event cards is drawn during the play of the game;

(e) providing for said plurality of distinct spaces at least one of said distinct spaces specially marked so that when one of said playing tokens stops on said specially marked distinct space a player is required in draw one of said event cards from said portion of randomly ordered event cards stacked face down said plurality of distinct spaces including at least one of said distinct spaces marked with a caution circle;

(f) providing for said plurality of event cards to include at least one caution card said caution card containing instructions for declaring order played to simulate a caution during a race whereby said caution event card requires the token of leading player to move to next distinct space marked with a caution circle and said remaining tokens to be placed in a predetermined order at predetermined distinct spaces on said board thereby resulting in said tokens advancing around said lanes to said predetermined distinct spaces without using said random number generator;

(g) providing a means for ordering progress of said token around said lanes whereby strategy, skill, and luck play a part in how far said token advances so that one of said tokens to first complete a predetermined number of laps around any of said lanes determines a winner of said simulated automobile race.

17. A method of playing a game simulating an automobile race of claim 16 wherein said visual depiction of said game playing layout has a fourth lane connected to at least one of said contiguous lanes whereby a token may enter said fourth lane to simulate an automobile entering a pit lane during a race.

18. A method of playing a game simulating an automobile race of claim 17 wherein there is a further provision providing a portion of one of said contiguous lanes as marked for a first predetermined number of distinct spaces and said means for ordering includes drafting means for ordering to allow a player's token to advance more spaces than allocated by said random number generator when said token lands in a first predetermined number of distinct spaces.

19. A method of playing a game simulating an automobile race of claim 18 wherein there is a further provision and said means for ordering progress that includes a passing means for ordering when said token of a player may move laterally from one of said distinct spaces to a laterally adjacent distinct space in said contiguous lanes.

20. A method of playing a game simulating an automobile race of claim 19 wherein said providing a plurality of randomly ordered event cards includes at least one crash caution event card in said plurality of event cards whereby said crash caution event card requires an action to be performed by at least one token affecting progress of at least one token around said contiguous lanes to simulate the effects of a multi-car crash occurring during the course of an automobile race.

* * * * *